US008702201B2

(12) United States Patent
Nishida

(10) Patent No.: US 8,702,201 B2
(45) Date of Patent: Apr. 22, 2014

(54) INK DISCHARGE APPARATUS

(75) Inventor: Katsunori Nishida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 635 days.

(21) Appl. No.: 12/871,335

(22) Filed: Aug. 30, 2010

(65) Prior Publication Data

US 2011/0050799 A1 Mar. 3, 2011

(30) Foreign Application Priority Data

Aug. 31, 2009 (JP) ..... 2009-199287

(51) Int. Cl.
*B41J 2/165* (2006.01)

(52) U.S. Cl.
USPC ..... 347/30; 347/29; 347/32

(58) Field of Classification Search
USPC ..... 347/29–32
See application file for complete search history.

(56) References Cited

U.S. PATENT DOCUMENTS

| | | | | |
|---|---|---|---|---|
| 6,010,203 | A | 1/2000 | Muraki | |
| 7,997,701 | B2 * | 8/2011 | Yazawa | 347/86 |
| 2002/0005874 | A1 | 1/2002 | Imai et al. | |
| 2004/0252158 | A1 | 12/2004 | Shindo | |

FOREIGN PATENT DOCUMENTS

| | | |
|---|---|---|
| JP | 10-24598 | 1/1998 |
| JP | 2002-36594 | 2/2002 |
| JP | 2002-248781 | 9/2002 |
| JP | 2004-305978 | 11/2004 |
| JP | 2004-306428 | 11/2004 |

* cited by examiner

*Primary Examiner* — Kevin S Wood
(74) *Attorney, Agent, or Firm* — Scully, Scott, Murphy & Presser, PC

(57) ABSTRACT

An ink discharge apparatus is provided, including a discharge head which has a nozzle surface formed with a first nozzle for discharging an ink of a first color and a second nozzle for discharging an ink of a second color darker than the first color; a cap; a sucking mechanism which performs suction for a space in the cap; a moving mechanism which positions the cap at a capping position and at a retracted position; and a purge control mechanism which controls the moving mechanism so that the cap is separated from the nozzle surface while allowing a second distance between the cap and an area near the second nozzle to be smaller than a first distance between the cap and an area near the first nozzle after completion of a purge operation.

13 Claims, 13 Drawing Sheets

INK DISCHARGE APPARATUS

CROSS REFERENCE TO RELATED APPLICATION

The present application claims priority from Japanese Patent Application No. 2009-199287, filed on Aug. 31, 2009, the disclosure of which is incorporated herein by reference in its entirety.

BACKGROUND OF THE INVENTION

1. Field of the Invention

The present invention relates to an ink discharge apparatus which forms an image on a recording medium by discharging fine ink droplets from nozzles toward the recording medium such as a paper or the like.

2. Description of the Related Art

Conventionally, an ink discharge apparatus is known, which is exemplified by a printer apparatus based on the ink-jet system for forming an image on a recording medium by discharging inks toward the recording medium such as a paper or the like. Such an ink discharge apparatus includes a discharge head provided with nozzles for discharging the inks and ink cartridges accommodating the inks. The ink discharge apparatus discharges the inks supplied from the ink cartridges, from the nozzles of the discharge head.

The ink discharge apparatus as described above is provided with a discharge performance restoring mechanism in order to maintain the ink discharge function or the ink discharge performance of the nozzles. The discharge performance restoring mechanism is provided, for example, in order that the dust, the dried inks, and the bubbles, which exist in the discharge head, are removed when the maintenance is performed or the inks are initially charged into the discharge head. The discharge performance restoring mechanism includes, for example, a cap which covers a plurality of nozzles that are open on a nozzle surface of the discharge head, a suction pump which is connected to an ink discharge port formed through the cap via a connecting tube and which generates the negative pressure in the space formed between the cap and the nozzle surface, and a waste ink tank which is connected to the suction pump and which recovers the sucked waste ink.

The discharge performance restoring mechanism as described above performs the "capping operation" in which the nozzle surface of the discharge head is covered with the cap, it performs the "purge operation" in which the suction pump is operated to recover the waste ink from the discharge head, and it performs the "cap release operation" in which the cap is separated from the nozzle surface.

SUMMARY OF THE INVENTION

It is noted that the ink, which remains on the nozzle surface of the discharge head after the cap release operation, is pulled in or caught into the discharge head, because the negative pressure (back pressure), which is exerted in the pull-back direction, acts on the ink contained in the discharge head. The wipe operation is performed after the cap release operation, in which the ink remaining on the nozzle surface is wiped out with a wiper to remove the ink. However, the ink, which has been already caught into the discharge head, cannot be removed by the wipe operation. When a plurality of nozzles for discharging inks of mutually different colors are present on the nozzle surface of the discharge head, the inks of some colors may be pushed in or forced into the nozzles for discharging the ink of another color by means of the wipe operation in some cases. Accordingly, the "flashing operation" is performed continuously after the wipe operation, in which a minute amount of the ink is discharged from the nozzles once or a plurality of times in order to avoid the color mixture and maintain the stable jetting. In the flashing operation, for example, the ink and the bubbles, by which the interiors of the nozzles are invaded as a result of the back pressure and/or the wipe operation, are discharged.

In the flashing operation, the ink discharge is repeated until the foreign matter such as the bubbles contained in the nozzles is discharged and the color of the ink discharged from the nozzles is restored. That is, if there is such a possibility that the color mixture ink may exist in the nozzles after the wipe operation, the flashing operation is set so that the ink is discharged in an amount sufficient to successfully discharge all of the color mixture ink contained in the nozzles. Therefore, in such a situation, the jetting amount of the ink to be discharged in the flashing operation is increased, i.e., the amount of the ink, which is used for any purpose other than the original purpose of the printing or the like, is increased, and thus the ink is uselessly consumed. In particular, if the dark color ink such as the black is mixed into the nozzles for the pale color ink (light color ink) such as the yellow, then a resultant mixed color (color mixture) ink has a color darker than the pale color ink, and the harmful influence, which is exerted on the printing quality, is more serious. Therefore, it is necessary that the color mixture ink contained in the nozzles for the pale color ink should be reliably discharged. As a result, the jetting amount of the ink, which is discharged in the flashing operation described above, is increased.

The present inventors have found out the following fact. That is, especially during the cap release operation in which a cap formed with no atmospheric air communication hole is separated from the nozzle surface, an ink bridge, which is continuous to bridge the cap and the nozzle surface, is firstly formed, and then the ink is separated into those disposed on the nozzle surface side and the cap side so that the ink bridge is cut. Further, the present inventors have found out the fact that the mixing of the dark color ink into the nozzles for the pale color ink can be greatly mitigated by controlling the position at which the ink bridge is formed.

The present invention has been made in order to solve the problem as described above, an object of which is to provide an ink discharge apparatus provided with a plurality of nozzles for discharging inks of different colors including a dark color ink and a pale color ink paler than the dark color ink, wherein it is possible to reduce the advance of any ink subjected to the color mixture into the nozzles for the pale color ink after the purge operation.

According to an aspect of the present invention, there is provided an ink discharge apparatus which discharges a first ink of a first color and a second ink of a second color darker than the first color, the ink discharge apparatus including:

a discharge head which has a nozzle surface formed with a first nozzle through which the first ink is discharged and a second nozzle through which the second ink is discharged;

a cap which covers the first and second nozzles and which has an inner bottom surface facing the nozzle surface under a condition that the cap covers the first and second nozzles and a wall portion formed on the inner bottom surface;

a sucking mechanism which performs suction for a space defined by the cap and the nozzle surface;

a moving mechanism which moves the cap relative to the discharge head such that the cap is positioned at a capping position at which the cap covers the first and second nozzles, and that the cap is positioned at a retracted position at which the cap is separated from the discharge head; and a purge control mechanism which controls the sucking mechanism and the moving mechanism, wherein in a state that the cap is positioned at the capping position, the purge control mechanism controls the sucking mechanism so that a purge operation is performed to suck the first and second inks present in the first and second nozzles via the cap, and after completion of the purge operation, the purge control mechanism controls the moving mechanism so that the cap is separated from the nozzle surface while making a second distance between the inner bottom surface and an area of the nozzle surface disposed in the vicinity of the second nozzle is smaller than a first distance between the inner bottom surface and an area of the nozzle surface disposed in the vicinity of the first nozzle.

In the ink discharge apparatus constructed as described above, the ink bridge, which is formed between the cap and the nozzle surface when the cap is separated from the nozzle surface of the discharge head after the completion of the purge operation, is formed in the area of the nozzle surface in which the nozzle array for the dark color ink is formed or in the area which is disposed in the vicinity thereof. When the ink bridge is formed in the areas as described above, then the flow, which is directed toward the nozzle array for the dark color ink, is generated in the ink on the nozzle surface, and it is possible to suppress the dark color ink from flowing toward the pale color ink paler than the dark color ink on the nozzle surface. Accordingly, it is possible to reduce the advance of the ink of any other color into the nozzles, especially into the nozzles for the pale color ink after the completion of the purge operation, and it is possible to reduce the color mixture of the inks in the nozzles of the discharge head. Owing to the reduction of the color mixture of the inks in the nozzles of the discharge head, the number of times of the flashing is not uselessly increased in the flashing operation, and it is possible to suppress the increase in the ink consumption amount.

BRIEF DESCRIPTION OF THE DRAWINGS

FIGS. 5A and 5B show an embodiment in which a cap is released downwardly from a capping state shown in FIG. 3, wherein FIG. 5A shows a first separation state in which the cap is moved downwardly by a predetermined distance, and FIG. 5B shows a second separation state in which the cap is further moved downwardly.

FIGS. 7A and 7B show an embodiment in which a cap is released downwardly from a capping state shown in FIG. 6, wherein FIG. 7A shows a first separation state in which the cap is moved downwardly by a predetermined distance, and FIG. 7B shows a second separation state in which the cap is further moved downwardly.

FIGS. 12A and 12B show an embodiment in which a cap is released downwardly from a capping state shown in FIG. 11, wherein FIG. 12A shows a first separation state in which the cap is moved downwardly by a predetermined distance, and FIG. 12B shows a second separation state in which the cap is further moved downwardly.

DESCRIPTION OF THE PREFERRED EMBODIMENTS

Figure 1:
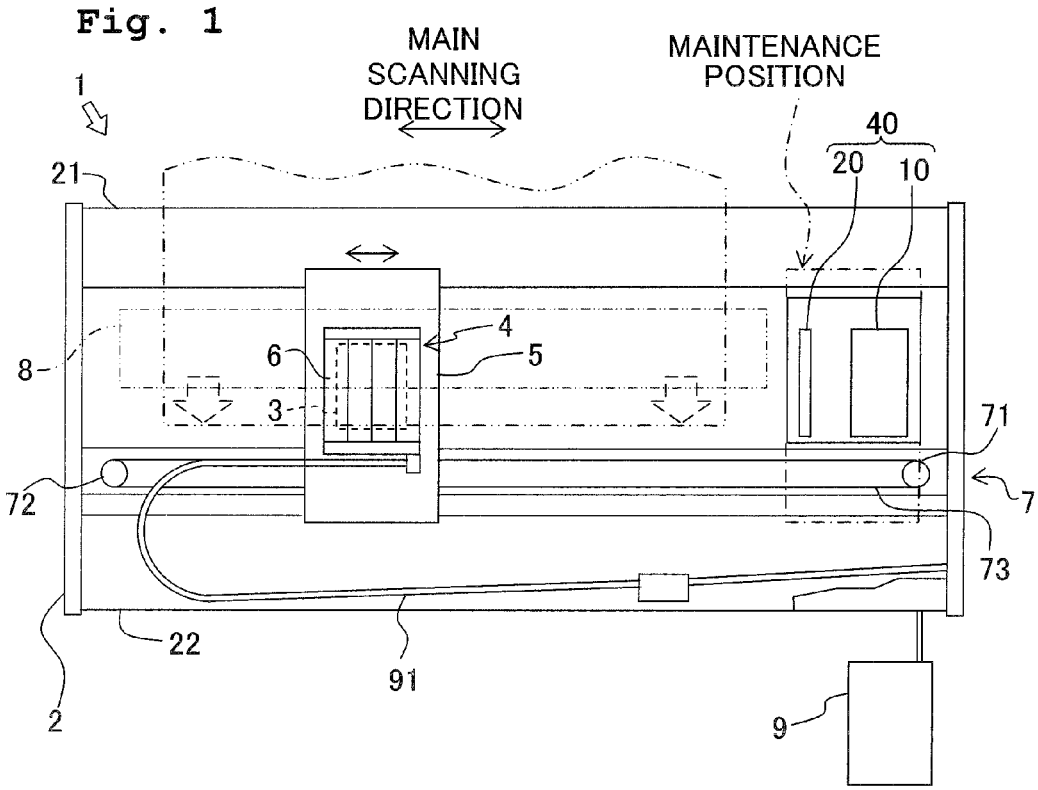
FIG. 1 shows a schematic plan view illustrating main components of an ink-jet type printer as an ink discharge apparatus.

An explanation will be made in detail below with reference to the drawings about an embodiment to carry out the present invention. In the following description, the same or corresponding elements are designated by the same reference numerals throughout all of the drawings, any duplicate explanation of which will be omitted.

First Embodiment

An explanation will be made below with reference to the drawings as exemplified by an ink-jet type color printer apparatus (printer 1) as the ink discharge apparatus according to a first embodiment by way of example. The printer 1 shown below is the ink-jet type color printer based on the ink-jet system in which an image is printed by discharging inks of four colors (black (Bk), yellow (Y), cyan (C), and magenta (M)) to a paper as a recording medium.

As shown in FIG. 1, the printer 1 includes a frame (body frame) 2, a carriage 5 which is provided on the frame 2 so that the carriage 5 is reciprocatively movable in the main scanning direction (left-right direction as viewed in FIG. 1), and a discharge head unit 4 which is carried on the carriage 5. A platen 8 is provided in the frame 2. The recording medium is transported in the frontward direction (direction toward the front as viewed in FIG. 1) by means of, for example, an unillustrated feed roller on the platen 8.

The carriage 5 is reciprocatively movable in the main scanning direction along with two guide shafts 21, 22 provided on the frame 2 as well, by means of a scanning mechanism 7 provided on the frame 2. The scanning mechanism 7 includes, for example, a driving pulley 71 which is provided on the main frame 2 at one end side in the main scanning direction and which is driven and rotated positively/negatively (clockwise/counterclockwise) by a motor (not shown), a driven pulley 72 which is provided on the main frame 2 at the other end side in the main scanning direction, and an endless belt 73 which is wound around the pulleys 71, 72. The carriage 5 is fixed to the endless belt 73. When the driving pulley 71 is driven and rotated in the positive direction or the opposite direction, the endless belt 73 is also rotated in the positive direction or the opposite direction. In this situation, the carriage 5 is moved in the main scanning direction in accordance with the endless belt 73.

Figure 2:
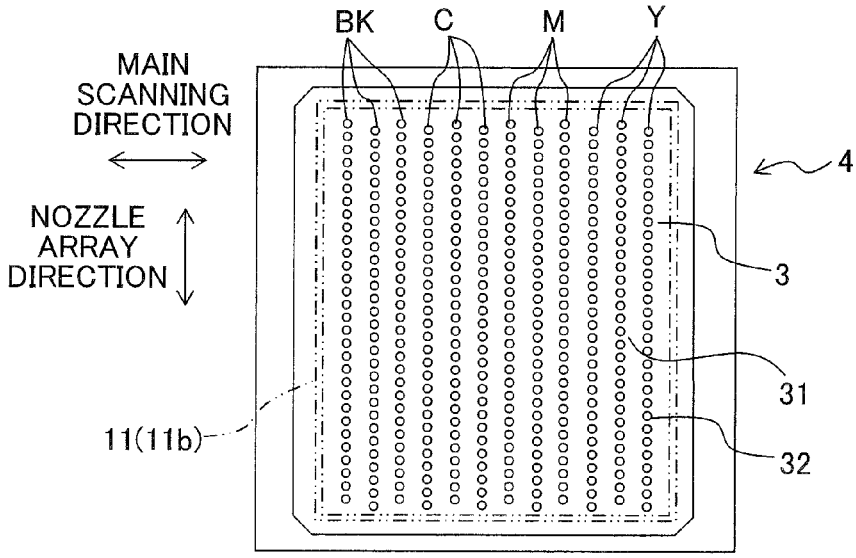
FIG. 2 schematically shows an arrangement of a nozzle surface of a discharge head.

The discharge head unit 4 is provided with a discharge head 3. As shown in FIG. 2, a plurality of nozzles 32, through which minute liquid droplets of inks are discharged toward the recording medium, are formed on a bottom surface of the discharge head 3. In the following description, the bottom surface of the discharge head 3 (discharge head unit 4), on which the plurality of nozzles 32 are open, is referred to as "nozzle surface 31". Those existing on the nozzle surface 31 include at least the nozzles for the dark color inks for discharging the dark color inks, and the nozzles for the pale color inks for discharging the pale color inks. In this arrangement, the nozzles, through which the same color ink is discharged, are aligned in a nozzle array direction which is substantially perpendicular to the main scanning direction so that the nozzles form a nozzle array. In this embodiment, the nozzle arrays for black (Bk), cyan (C), magenta (M), and yellow (Y) are arranged side by side in this order in the main scanning direction. In other words, the nozzle array for the black as the darkest color ink is arranged at one end in the main scanning direction, and the nozzle array for the yellow as the palest color ink is arranged at the other end on the nozzle surface 31.

The "dark color ink" described above refers to the ink having the dark color as compared with the pale color ink. For example, when the four color inks (black (Bk), yellow (Y), cyan (C), and magenta (M)) are used as in this embodiment, then the black, the cyan, and the magenta are the dark color inks, and the yellow is the pale color ink. In this case, the black is the darkest color ink. For example, when the six color inks of black (Bk), yellow (Y), cyan (C), magenta (M), light cyan (LC), and light magenta (LM) are used, then the black, the cyan, and the magenta are the dark color inks, the yellow, the light cyan, and the light magenta are the pale color inks, and the black is the darkest color ink.

The discharge head unit 4 has four subtanks 6 which are arranged over or above the discharge head 3 and which are connected to corresponding ink flow passages included in the discharge head 3. The four subtanks 6 are connected by tubes 91 to four ink cartridges 9 which are disengageably installed to the printer 1. The inks contained in the ink cartridges 9 are supplied to the discharge head 3 via the subtanks 6. The four subtanks 6 and the four ink cartridges correspond to the four color inks respectively.

The discharge head 3 discharges the inks of the respective colors from the nozzles 32 respectively to the recording medium to be transported, while the discharge head 3 is reciprocatively moved in the main scanning direction integrally with the carriage 5 within a range in which the discharge head 3 is opposed to the platen 8. Accordingly, a desired image is printed by the discharge head 3 on the recording medium. On the other hand, when the image is not printed or when the maintenance is performed, then the discharge head 3 is retracted, integrally with the carriage 5, to the maintenance position disposed on one side of the platen 8 in the main scanning direction (right side as viewed in FIG. 1). A maintenance mechanism 40 is provided under or below the discharge head 3 retracted to the maintenance position. The maintenance mechanism 40 includes a purge unit 10 which is provided to execute the purge operation for forcibly discharging, for example, the air together with the inks to the outside from the nozzles 32 of the discharge head 3, and a wiper 20 which is provided to wipe out the inks adhered to the nozzle surface 31.

Figure 3:
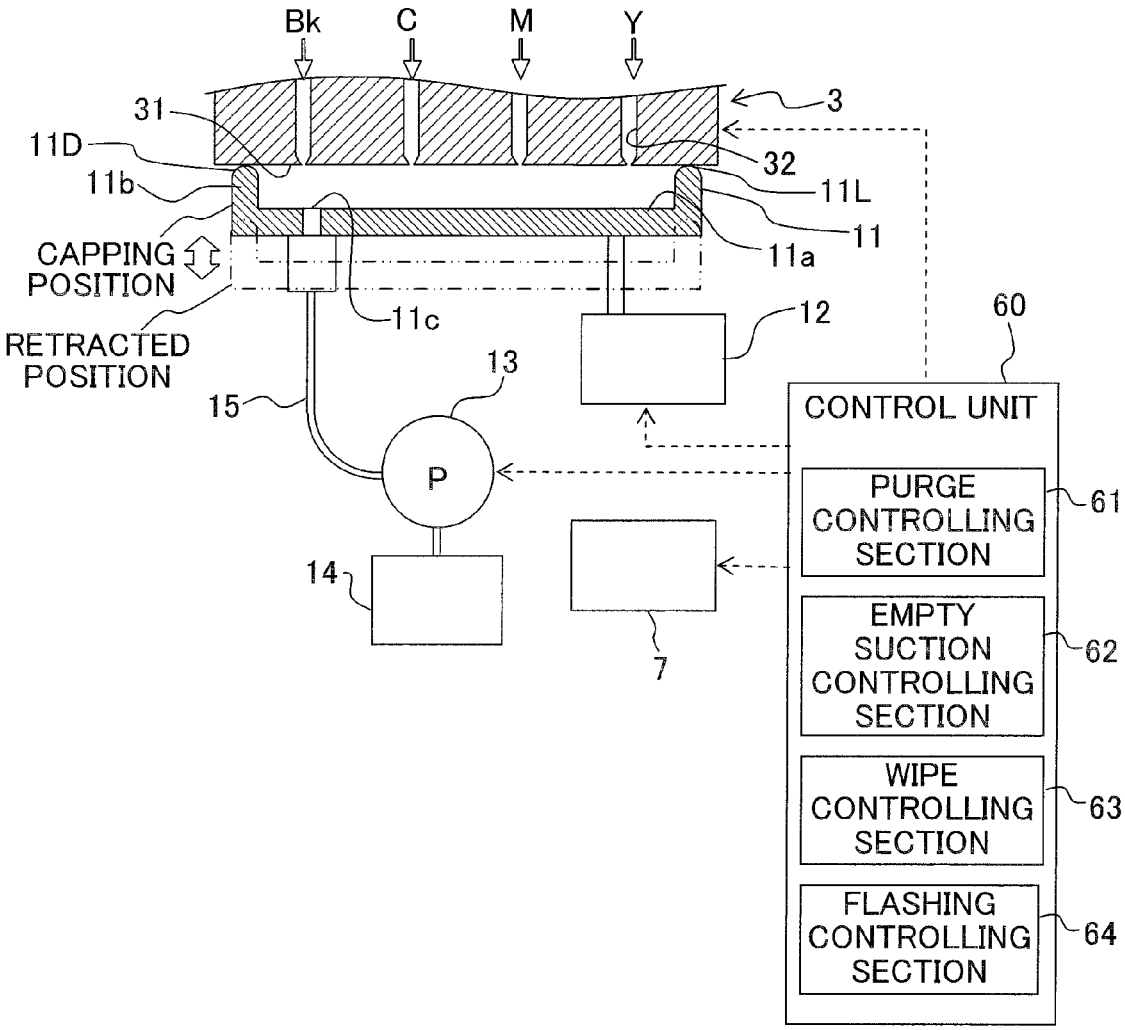
FIG. 3 schematically shows an arrangement in relation to the maintenance for the printer.

The purge unit 10 will now be explained with reference to FIGS. 2 and 3. As shown in FIG. 3, the purge unit 10 is provided with a cap 11 which is arranged under or below the discharge head 3 disposed at the maintenance position, a moving mechanism 12 which moves the cap 11, a suction pump 13 which is communicated with the cap 11, and a waste ink tank 14 which is communicated with the suction pump 13. The cap 11 has a box-shaped form which is open at the upper portion thereof and which is formed with a bottom wall portion 11*a* and a circumferential wall portion 11*b* provided on four sides of the bottom wall portion 11*a*. As described later on, an internal space, which is defined by the nozzle surface 31, the bottom wall portion 11*a*, and the circumferential wall portion 11*b* when the circumferential wall portion 11*b* of the cap 11 is allowed to abut against the nozzle surface 31 of the discharge head 3, is the ink suction space. As shown in FIG. 2, the cap 11 according to this embodiment has a substantially rectangular shape which is one size smaller than the nozzle surface 31 of the discharge head 3 as viewed in a plan view. The cap 11 is formed so that the cap 11 can surround or cover all of the plurality of nozzles 32 which are open on the nozzle surface 31 by means of a frame composed of the circumferential wall portion 11*b* thereof.

The moving mechanism 12 moves the cap 11 between the capping position (upper position) at which the upper end portion of the circumferential wall portion 11*b* abuts against the nozzle surface 31 and the retracted position (lower position) at which the upper end portion of the circumferential wall portion 11*b* is separated from the nozzle surface 31. The moving mechanism 12 is constructed to move the cap 11 from the capping position to the retracted position in such a posture or attitude that the inner bottom surface of the cap 11 (upper surface of the bottom wall portion 11*a*) is inclined in the direction substantially perpendicular to the nozzle array direction (scanning direction, nozzle array alignment direction). When the cap 11 is at the capping position, the circumferential wall portion 11*b* of the cap 11 is brought in tight contact with the nozzle surface 31 so that the plurality of nozzles 32 are surrounded thereby. The structure of the moving mechanism 12 will be described later on.

Further, a discharge hole 11*c*, which penetrates through the bottom wall portion 11*a* of the cap 11, is formed through the bottom wall portion 11*a* of the cap 11. It is desirable that the discharge hole 11*c* of the cap 11 is formed in an area, of the bottom wall portion 11*a*, opposed to the nozzles for the dark color ink disposed on the nozzle surface 31. The suction pump 13 is connected to the discharge hole 11*c* of the cap 11 via a connecting tube 15. The discharge ink tank 14, which recovers the sucked waste ink, is connected to the suction pump 13. An air inlet port, which is formed to penetrate the cap 11 and through which an air outside the cap 11 enters into the ink suction space after the completion of the purge operation as described below, is not formed in the cap 11. In other words, no through hole other than the discharge hole 11*c* through which the waste ink are discharged is formed in the cap 11.

Next, an explanation will be made about the construction of a control unit for performing the control concerning the maintenance process for the printer 1. As shown in FIG. 3, the printer 1 is provided with the control unit 60. The control unit 60 includes unillustrated MPU, Programmable Read-Only Memory (PROM), ROM composed of mask ROM or the like, and RAM. The suction pump 13, the moving mechanism 12, the scanning mechanism 7, and the discharge head 3 are connected to the control unit 60 to control the control objectives. ROM records the data and the program required to execute at least the maintenance process as explained in this embodiment. MPU executes the program recorded in ROM while making reference to the data recorded in ROM and the information recorded in RAM. Accordingly, the control unit 60 also functions as a purge control section 61 which controls the purge operation as described later on, an empty suction control section 62 which controls the empty suction operation, a wipe control section 63 which controls the wipe operation, and a flashing control section 64 which controls the flashing operation.

Figure 4:
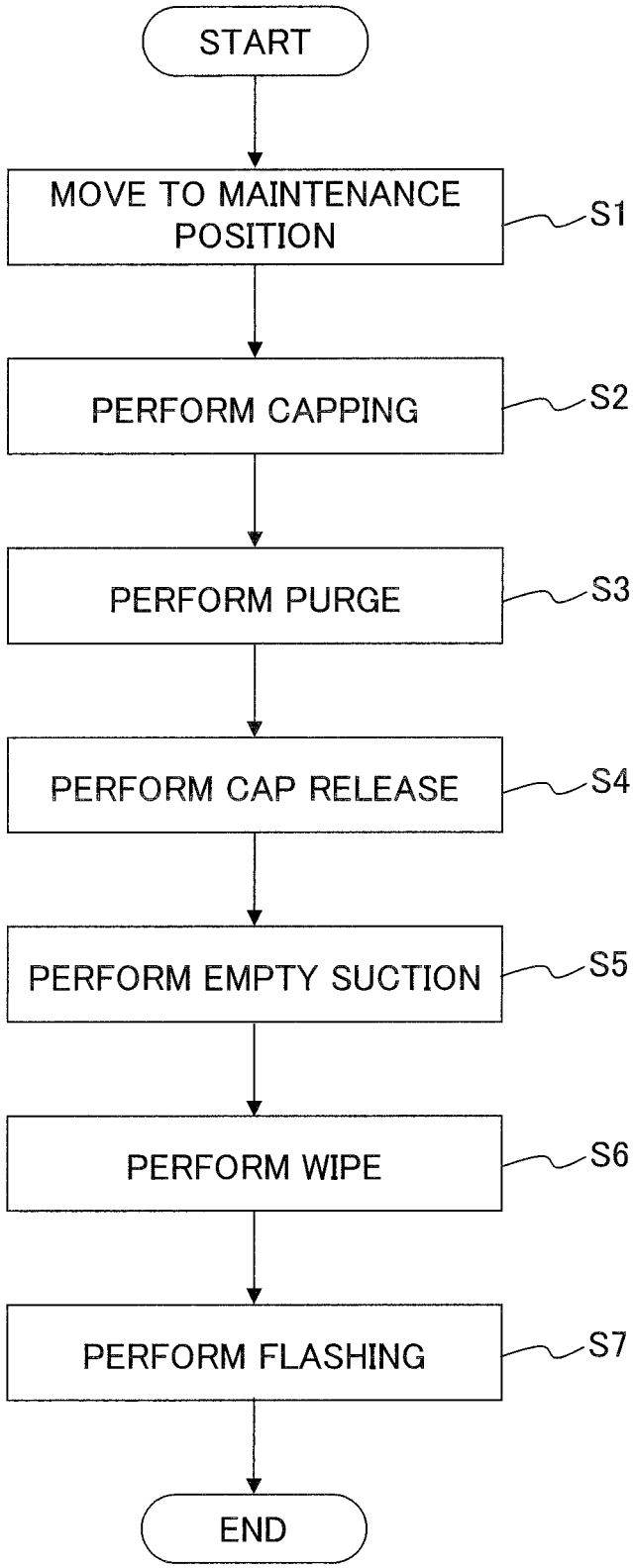
FIG. 4 shows a flow chart illustrating a maintenance process.

Next, the maintenance process for the printer 1 will be explained. As shown in FIG. 4, when the maintenance process is started for the printer 1, the control unit 60 firstly drives the scanning mechanism 7 to move the discharge head unit 4 to the maintenance position (Step S1). Subsequently, the control unit 60 drives the moving mechanism 12 so that the printer 1 executes the capping operation (Step S2). In accordance with the capping operation, the cap 11 is moved to the capping position at which the entire circumferential wall portion 11*b* thereof is in brought in contact with the nozzle surface 31 to give a state in which the nozzle surface 31 is covered with the cap 11. In this state, the control unit 60 drives the suction pump 13 so that the printer 1 executes the purge operation (Step S3). The purge operation is realized by the purge control section 61 of the control unit 60 by controlling the scanning mechanism 7, the moving mechanism 12, and the suction pump 13 to perform the purge operation. In accordance with the purge operation, the ink is discharged to the ink suction space of the cap 11.

Subsequently, the control unit 60 drives the moving mechanism 12 again so that the printer 1 executes the cap release operation (Step S4). In accordance with the cap release operation, the cap 11 is moved from the capping position to the retracted position separated by a predetermined distance from the nozzle surface 31.

Figure 5A:
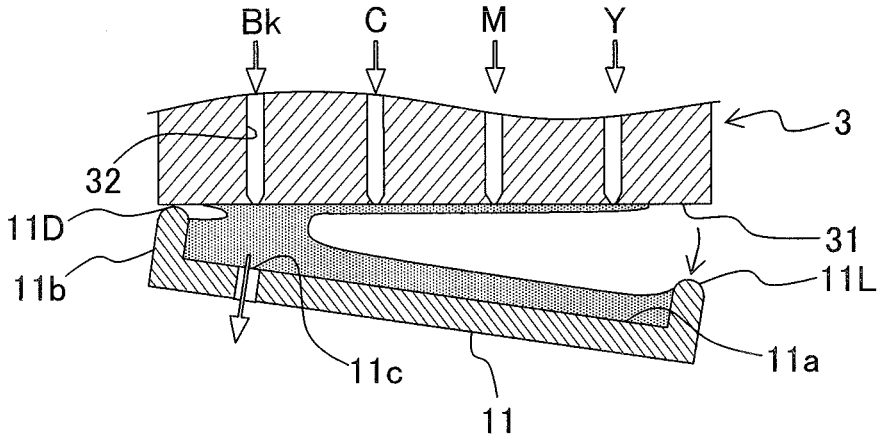

In the cap release operation, the cap 11, which is in the capping state (FIG. 3), is inclined in the direction substantially perpendicular to the nozzle array direction with respect to the nozzle surface 31. In this situation, the cap 11 is brought in contact with the vicinity of the area of the nozzle surface 31 in which the nozzle array for the darkest color ink is formed. In other words, one side (11D) of the circumferential wall portion 11*b* of the cap 11 is brought in contact with the area disposed in the vicinity of the area of the nozzle surface 31 in which the nozzle array for the dark color ink is formed. Simultaneously, the other side (11L) of the circumferential wall portion 11*b* of the cap 11, which has been brought in contact with the vicinity of the area of the nozzle surface 31 in which the nozzle array for the pale color ink is formed, is separated from the nozzle surface 31. The state as described above is referred to as the "first separation state (FIG. 5A)". The relationship holds, in which a first distance is smaller than a second distance during the period in which the state is changed from the capping state to arrive at the first separation state. The first distance is defined as a distance between the inner bottom surface of the cap 11 (upper surface of the bottom wall portion 11*a*) and the area of the nozzle surface 31 formed with the nozzle array for the dark color ink and the area disposed in the vicinity thereof. The second distance is defined as a distance between the inner bottom surface of the cap 11 and the area of the nozzle surface 31 formed with the nozzle array for the pale color ink and the area disposed in the vicinity thereof. The area of the nozzle surface 31 formed with the nozzle array for the dark color ink and the area disposed in the vicinity thereof are referred to as the "dark color nozzle area", and the area of the nozzle surface 31 formed with the nozzle array for the pale color ink and the area disposed in the vicinity thereof are referred to as the "pale color nozzle area". In particular, the area of the "dark color nozzle area" formed with the nozzle array for the darkest color ink and the area disposed in the vicinity thereof are referred to as the "darkest color nozzle area".

The inks, which remain while being scattered over the entire nozzle surface 31, are collected in a small area to form one ink bridge during the period in which the state is changed from the capping state to arrive at the first separation state. The ink bridge is moved toward the portion at which the distance between the nozzle surface 31 and the cap 11 is relatively small. Therefore, the ink bridge arrives at the dark color nozzle area as the area in which the distance between the nozzle surface 31 and the cap 11 is relatively small. In the cap release operation, it is preferable that the relative movement of the cap 11 with respect to the nozzle surface 31 is allowed to stop in a certain period of time in the first separation state so that the ink bridge is reliably collected at the dark color nozzle area.

Figure 5B:
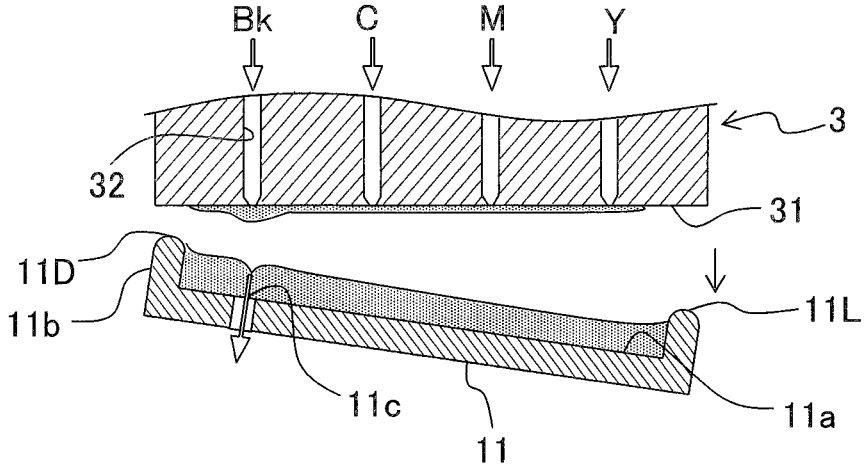

In the cap release operation, the cap 11 and the nozzle surface 31 are in the first separation state, and then the cap 11 is further separated from the nozzle surface 31 and moved to the retracted position, while maintaining the posture in which the cap 11 is inclined in the direction substantially perpendicular to the nozzle array direction with respect to the nozzle surface 31. Accordingly, the "second separation state (FIG. 5B)" is given, in which the entire circumferential wall portion 11*b* of the cap 11 is separated from the nozzle surface 31. The ink bridge, which is collected at the dark color nozzle area, is elongated in the direction of separation, and the ink bridge is cut during the period in which the state is changed from the first separation state to the second separation state. The relationship also holds, in which the distance between the inner bottom surface of the cap 11 and the dark color nozzle area is smaller than the distance between the inner bottom surface of the cap 11 and the pale color nozzle area, during the period in which the state is changed from the first separation state to arrive at the second separation state. The degree of the inclination of the cap 11 with respect to the nozzle surface 31 in the first separation state may be set arbitrarily. For example, in this embodiment, the cap 11 is inclined with respect to the nozzle surface 31 to such an extent that the gap between the nozzle surface 31 and the other side 11L of the circumferential wall portion 11*b* of the cap 11 is about 0.3 mm, while the width of the discharge head 3 (width of the discharge head 3 in the left-right direction as viewed in FIG. 5A) is about 20 mm.

After the cap release operation (Step S4), the control unit 60 drives the suction pump 13 so that the empty suction operation is executed (Step S5). Specifically, the empty suction operation is realized by controlling, for example, the suction pump 13 by the empty suction control section 62 of the control unit 60. In the empty suction operation, the empty suction control section 62 drives the suction pump 13 at a suction speed suitable for the empty suction operation in the state in which the cap 11 is disposed at the retracted position. The suction pump 13 is stopped when a total suction volume required for the empty suction operation is completely sucked, and the empty suction operation comes to an end. The empty suction operation may be started when the ink bridge is formed between the cap 11 and the nozzle surface 31 during the cap release operation. Alternatively, the empty suction may be started when the cap 11 begins to be detached from the nozzle surface 31.

After the empty suction operation (Step S5), the control unit 60 drives the scanning mechanism 7 so that the wipe operation is executed (Step S6). Specifically, the wipe operation is realized by controlling, for example, the scanning mechanism 7 by the wipe control section 63 of the control unit 60. In the wipe operation, the wipe control section 63 moves the carriage 5 (or a wiper 20) while the wiper 20 abuts against the nozzle surface 31 of the discharge head 3. Accordingly, any ink, which adheres to the nozzle surface 31, is wiped out. In this arrangement, the direction, in which the wiper 20 wipes out the nozzle surface 31, is not necessarily limited. When the wiping is performed in the scanning direction substantially perpendicular to the extending direction of the nozzle array as in this embodiment, it is preferable that the wiping is performed with the wiper 20 from the pale color nozzle area toward the dark color nozzle area in such a viewpoint that the dark color ink, which exists on the nozzle surface 31, is not allowed to enter into the nozzles for the pale color ink.

After the wipe operation (Step S6), the control unit 60 drives the discharge head 3 so that the flashing operation is executed (Step S7), and the maintenance process comes to an end. Specifically, the flashing operation is realized by controlling, for example, the discharge head 3 by the flashing control section 64 of the control unit 60. In the flashing operation, the flashing control section 64 allows the discharge head 3 to discharge a minute amount of the ink once or a plurality of times, and the color of the ink to be discharged from the nozzles 32 is restored.

In the maintenance process for the printer 1 described above, the cap 11 is separated from the nozzle surface 31, while the distance between the inner bottom surface of the cap 11 and the dark color nozzle area is smaller than the distance between the inner bottom surface of the cap 11 and the pale color nozzle area in the cap release operation (Step S4). The moving mechanism 12 is controlled as described above. Therefore, the ink bridge, which is formed between the cap 11 and the nozzle surface 31 during the cap release operation, is formed in the dark color nozzle area.

When the ink bridge is formed between the cap 11 and the nozzle surface 31 in the cap release operation, the flow arises in the ink on the nozzle surface 31 so that the ink is collected into the ink bridge. Therefore, when the ink bridge is formed in the dark color nozzle area, the flow arises in the ink on the nozzle surface 31, which is directed toward the nozzle array for the dark color ink. In other words, it is possible to prevent the dark color ink from flowing toward the nozzle array for the pale color ink on the nozzle surface 31. The ink, which remains on the nozzle surface 31, is subjected to the counterflow toward each of the nozzles due to the back pressure generated in the discharge head 3, during the period ranging from the cap release operation (Step S4) to the wipe operation (Step S6). However, in the cap release operation described above, it is possible to suppress the occurrence of the color mixture of the inks which would be otherwise caused such that the ink of any other color (dark color ink) is allowed to advance into or enter the nozzles especially for the pale color ink. Owing to the suppression of the color mixture of the ink in the nozzles for the pale color ink, the number of times of the flashing is not uselessly increased in the flashing operation (Step S7), and it is possible to suppress the amount of ink consumption.

The back pressure is generated in the discharge head 3. Therefore, the ink of any other color and the ink which suffers from the color mixture on the nozzle surface 31 undergo the counterflow into the nozzles for the dark color ink during the period ranging from the cap release operation (Step S4) to the wipe operation (Step S6). However, when the inks of a plurality of colors are mixed or subjected to the color mixture, the color of the color mixture ink approaches the black color. Therefore, the ink color is easily restored for the nozzles for the dark color ink as compared with the nozzles for the pale color ink in the flashing operation (Step S7). The number of times of the flashing is not uselessly increased. From this viewpoint, when a plurality of dark color inks are present in the inks to be carried on the printer 1, it is desirable that the ink bridge is formed in the darkest color nozzle area.

This embodiment is constructed such that one cap 11 is provided for the discharge head 3, and all of the nozzles 32 on the nozzle surface 31 are covered with the cap 11. However, a plurality of caps 11 may be provided for the discharge head 3 as well. For example, the cap 11 may include a first cap which covers the nozzle array for the black ink and a second cap which covers the nozzle arrays for the respective inks of cyan, magenta, and yellow. In this way, when the cap includes a plurality of caps, it is appropriate that at least one cap simultaneously covers the nozzle arrays for the inks of the plurality of colors. In this case, any arbitrary setting may be made in relation to which nozzle arrays for the inks of any colors should be covered with the cap for simultaneously covering the nozzle arrays for the inks of the plurality of colors. The moving mechanism may be constructed such that the cap 11 for covering the nozzle arrays for the inks of the plurality of colors is separated from the nozzle surface 31 so that the distance between the darkest color nozzle area and the inner bottom surface of the cap 11 is the smallest.

An explanation will now be made about a specified exemplary arrangement of the moving mechanism 12 for realizing the cap release operation described above. The moving mechanism 12 described below is constructed so that the cap 11 is moved in the direction to make separation from the nozzle surface 31 in such a posture that the cap 11 is inclined with respect to the nozzle surface 31.

Figure 6:
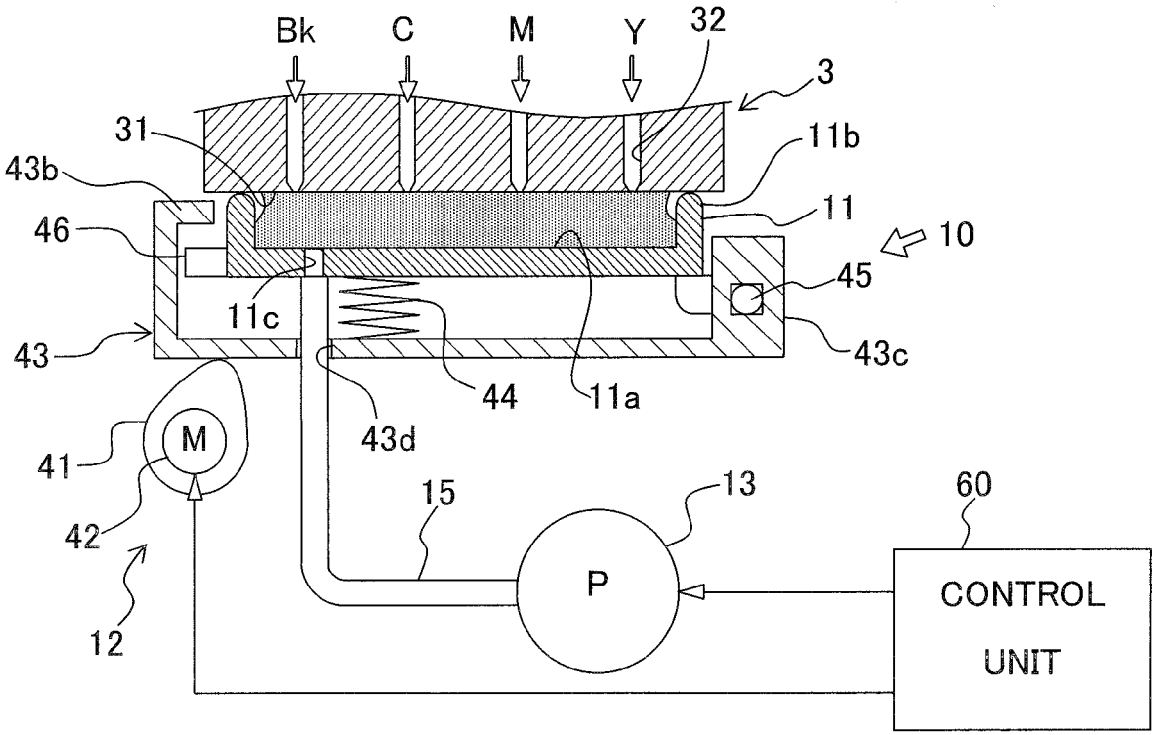
FIG. 6 schematically shows an arrangement of a purge unit of the ink-jet type printer according to a first embodiment.

As shown in FIG. 6, the moving mechanism 12 is provided with a cam 41 which has a profile, an electric motor 42 which is provided as a driving mechanism for driving and rotating the cam 41, and a cap holder 43 which accommodates the cap 11. The cap holder 43 has a box-shaped form which is open at the upper portion thereof. The cap 11 is accommodated in the cap holder 43. A coil spring 44, which is used as an urging mechanism, is provided on the inner bottom portion of the cap holder 43. The cap 11 is urged upwardly by the coil spring 44.

The cap 11 is provided with a locking projection 46 which is provided to protrude at one end portion of the bottom wall portion 11*a*. On the other hand, a projection shaped or protruding stopper 43*b* is provided, which is engageable with the locking projection 46 and which is provided at a portion of the cap holder 43 opposed to one end of the cap 11. The stopper 43*b* is provided over or above the locking projection 46. When the locking projection 46 abuts against the stopper 43*b*, the upper limit position is defined for the cap 11 which is urged by the coil spring 44.

A pivot support shaft 45, the axial center of which extends in the direction perpendicular to the plane of the paper in FIG. 6, is provided at the other end of the cap 11. A bearing portion 43*c*, a vertical length of which is longer than a horizontal length thereof and which performs the bearing action for the pivot support shaft 45, is provided at the other end of the cap holder 43. Therefore, the cap 11 is movable in the up-down direction in a range ranging from the lower limit position at which the cap 11 abuts against the inner bottom surface of the cap holder 43 to the upper limit position at which the locking projection 46 abuts against the stopper 43*b*. Owing to the pivot support shaft 45 supported by the bearing portion 43*c*, one end of the cap 11 is rotatable or swingable in the up-down direction with respect to the other end. The bearing portion 43*c* immovably supports the pivot support shaft 45 in relation to the vertical direction (in the up-down direction in FIG. 6).

In other words, the pivot support shaft 45 is restricted by the bearing portion 43*c* in the longitudinal direction of the bearing portion 43*c*.

The circumferential surface of the cam 41, which is disposed at the lower position, abuts against the cap holder 43 which accommodates the cap 11. The cam 41 is rotated by the driving of the electric motor 42 which is subjected to the operation control by the control unit 60. The cap holder 43 (as well as the cap 11) is moved upwardly and downwardly depending on the phase (angle of rotation) of the cam 41. When the cap holder 43 is moved upwardly when the discharge head 3 is at the maintenance position (see FIG. 1), then the cap 11 abuts against the nozzle surface 31 such that the plurality of nozzles 32 are covered therewith. On the other hand, when the cap holder 43 is moved downwardly, the cam 41 is reversely rotated. The cap holder 43 can be moved downwardly by means of the self-weight in accordance with the profile of the cam 41.

Figure 7A:
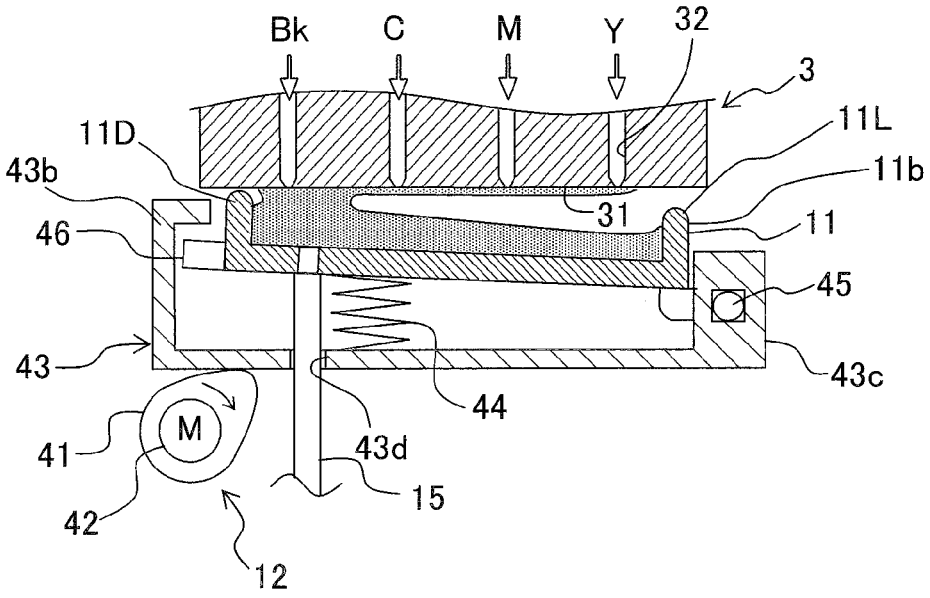

As shown in FIG. 7A, when the cam 41 is rotated by a predetermined angle to move the cap holder 43 downwardly, the cap 11 is urged upwardly by the coil spring 44. Therefore, the upper end surface of the circumferential wall portion 11*b*, which is positioned at one end portion (11D) of the cap 11, maintains the state of abutment against the nozzle surface 31. On the other hand, as for the other end portion (11L) of the cap 11, the pivot support shaft 45 is restricted by the bearing portion 43*c* in the longitudinal direction of the bearing portion 43*c*. Therefore, the upper end surface of the circumferential wall portion 11*b*, which is positioned at the other end portion, is separated downwardly from the nozzle surface 31. In this way, the cap 11 has an inclined posture in the first separation state, in which one end portion (11D) of the cap 11 is located at a position above the other end portion (11L).

Figure 7B:
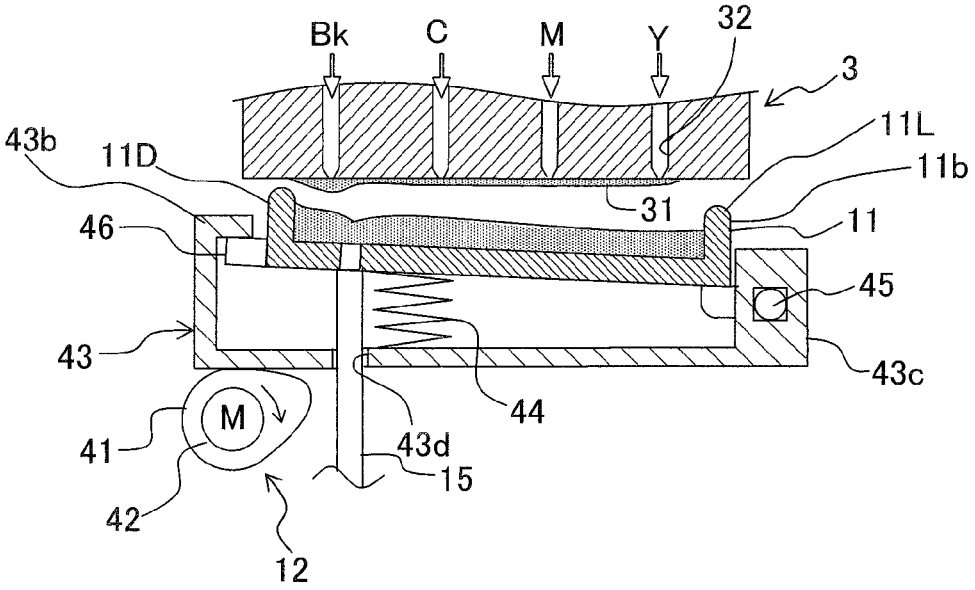

Subsequently, as shown in FIG. 7B, when the cam 41 is further rotated to move the cap holder 43 downwardly, the locking projection 46, which is disposed on one end side of the cap 11, abuts against the stopper 43*b* at an intermediate position. After that, the cap 11 is moved downwardly together with the cap holder 43, and the second separation state is given, in which the cap 11 is completely separated from the nozzle surface 31 while maintaining the inclined posture.

As described above, the moving mechanism 12 of the printer 1 shown in FIG. 6 can move the cap 11 from the capping state via the first separation state (FIG. 7A) to the second separation state (FIG. 7B), the capping state being a state in which the cap 11 abuts against the nozzle surface 31 to cover the nozzles 32 therewith, the first separation state being a state in which the cap 11 abuts against the nozzle surface 31 at one end portion (11D) while the cap 11 is inclined, and the second separation state being a state in which the cap 11 is completely separated or isolated from the nozzle surface 31.

First Modified Embodiment

Figure 8:
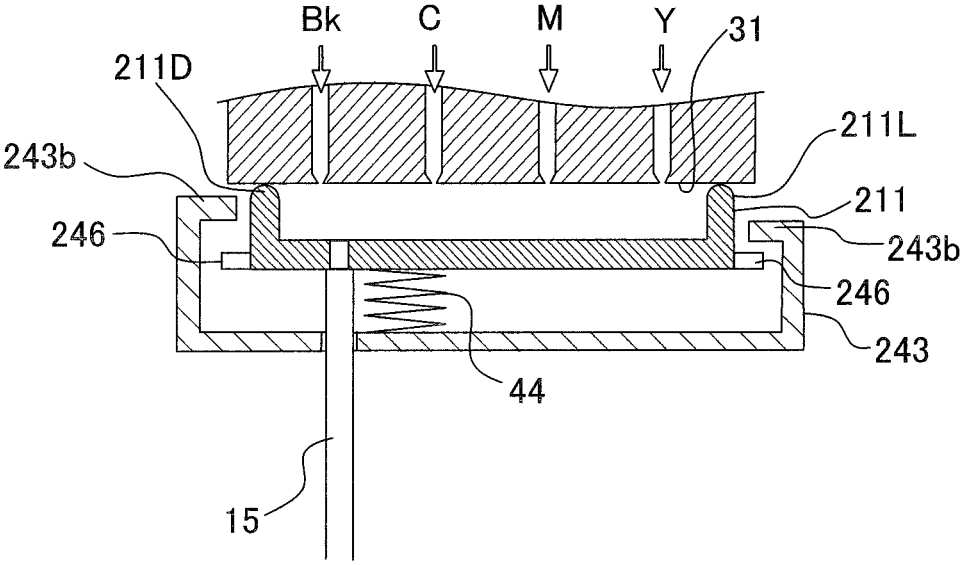
FIG. 8 schematically shows a cap and a cap holder according to a first modified embodiment.

In the foregoing description, the pivot support shaft 45, which is formed at one end of the cap 11, is restricted by the bearing portion 43*c* of the cap holder 13. However, the present teaching is not limited thereto. For example, as shown in FIG. 8, the following arrangement is also available. That is, locking projections 246 are formed at both ends of a cap 211 respectively. Projection-shaped or protruding stoppers 243*b*, which are engageable with the locking projections 246, are provided at portions of a substantially box-shaped cap holder 243 opposed to the both ends of the cap 211 respectively. In this arrangement, the stopper 243*b*, which is disposed on the left side shown in FIG. 8 (on the side near to the nozzles for the black ink), is formed at a position (position near to the nozzle surface 31) higher than that of the stopper 243*b* which is disposed on the right side shown in FIG. 8 (on the side near to the nozzles for the yellow ink).

When the cap holder 243 is progressively moved downwardly in the same manner as in the foregoing description from the capping position shown in FIG. 8, the right stopper 243*b* is firstly engaged with the locking projection 246 of the cap 211 which is disposed near to the nozzles for the yellow ink as the pale color ink. In this situation, the left stopper 243*b* is not engaged with the locking projection 246 of the cap 211 which is disposed near to the nozzles for the black ink as the dark color ink. Further, the coil spring 44 urges the cap holder 243 toward the nozzle surface 31 in the same manner as in the foregoing description. Therefore, when the cap holder 243 is moved downwardly in this state, the cap 211 is inclined so that the right one end portion (the other end portion) 211L is separated from the nozzle surface 31, while the left one end portion 211D is brought in contact with the nozzle surface 31. When the cap holder 243 is further moved downwardly, the left stopper 243*b* is also engaged with the locking projection 246 of the cap 211 which is disposed near to the nozzles for the black ink as the dark color ink. Therefore, the cap 211 is separated from the nozzle surface 31 while maintaining the inclined posture as described above.

Even in such a case, the cap 211 can be moved from the capping state, in which the cap 211 abuts against the nozzle surface 31 to cover the nozzles 32 therewith, via the first separation state, in which the cap 211 abuts against the nozzle surface 31 at one end portion (211D) while the cap 211 is inclined, to the second separation state in which the cap 211 is completely separated or isolated from the nozzle surface 31. In the foregoing description, the locking projections, which are formed for the cap, are formed at approximately the same position in relation to the movement direction of the cap, and the stoppers, which are formed for the cap holder, are formed at the stepped positions. On the contrary, the stoppers, which are formed for the cap holder, may be formed at approximately the same position, and the locking projections, which are formed for the cap, may be formed at stepped positions.

Second Modified Embodiment

Figure 9A:
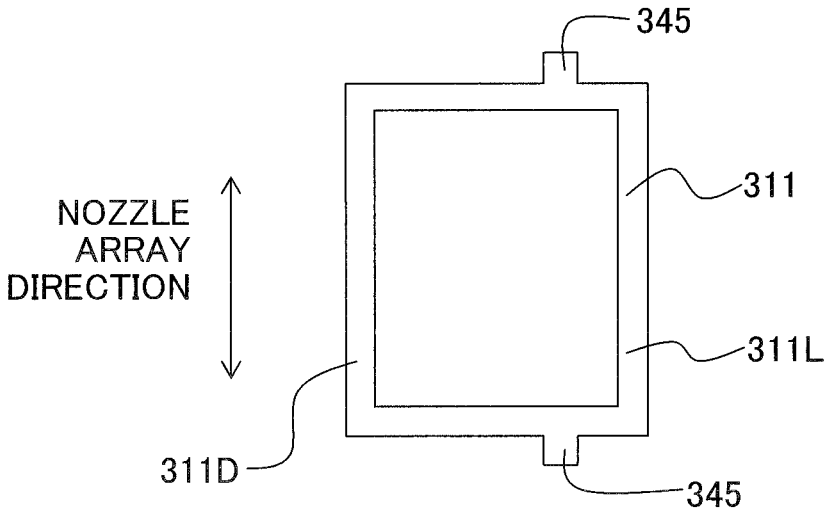
FIG. 9A shows a top view illustrating a cap and a cap holder according to a second modified embodiment.
Figure 9B:
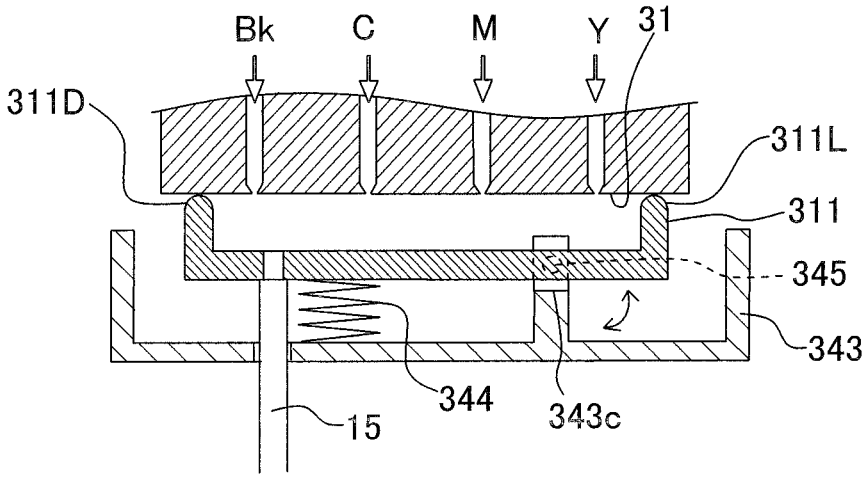
FIG. 9B shows a side view illustrating the cap and the cap holder according to the second modified embodiment.

As shown in FIG. 9A, the following arrangement is also available. That is, pivot support shafts 345 are formed at both ends of a substantially box-shaped cap 311 in the extending direction of the nozzle array. The cap 311 is rotatably supported by bearing portions 343*c* of a cap holder 343 so that the cap 311 is rotatable in the direction of the arrow shown in FIG. 9B. In this arrangement, as shown in FIG. 9B, the position, at which the coil spring 344 urges the cap 311, is arranged while being deviated from the pivot support shafts 345 in the direction perpendicular to the nozzle array extending direction. Specifically, the coil spring 344 urges the cap 311 at the position nearer to the nozzle array for the dark color ink as compared with the pivot support shafts 345 in the perpendicular direction. Therefore, when the cap holder 343 is moved downwardly, the cap 311 is inclined so that one end portion 311L (the other end portion), which is disposed on the side near to the nozzle array for the pale color ink, is separated from the nozzle surface 31, while one end portion 311D, which is disposed on the side near to the nozzle array for the dark color ink, is brought in contact with the nozzle surface 31. When the cap holder 343 is further moved downwardly, the cap 311 is separated from the nozzle surface 31 while maintaining the inclined posture as described above.

Also in the first and second modified embodiments as described above, the ink bridge, which is formed between the cap 211, 311 and the nozzle surface 31 during the cap release operation, can be formed in the dark color nozzle area.

Second Embodiment

A second embodiment of the present teaching will be explained. The purge unit 10 of the printer 1 according to the first embodiment described above is constructed such that the cap 11 is separated from the nozzle surface 31 in the posture in which the cap 11 is inclined with respect to the nozzle surface 31 during the cap release operation after the purge operation. On the contrary, a purge unit 10A of a printer according to the second embodiment is constructed such that a cap 11 is separated from the nozzle surface 31 while the nozzle surface 31 is inclined during the cap release operation after the purge operation.

The printer according to this embodiment is constructed in the same manner as the printer 1 according to the first embodiment except for the purge unit 10A and the support structure of the carriage 5. Therefore, in the following description, the support structure of the carriage 5 and the purge unit 10A will be explained in detail, and any explanation overlapped with the first embodiment will be omitted.

Figure 10:
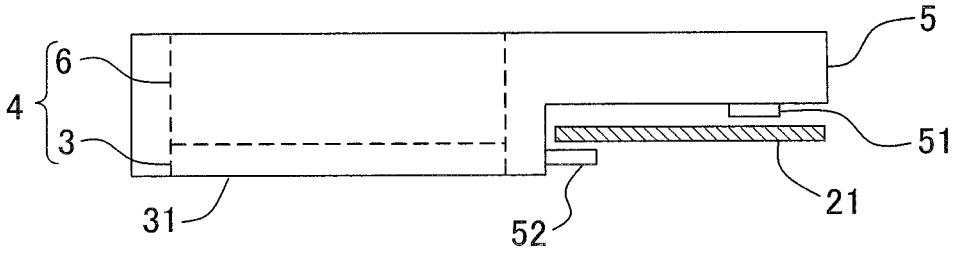
FIG. 10 shows a schematic side view illustrating an arrangement of a carriage and a guide shaft of an ink-jet type printer according to a second embodiment.
Figure 11:
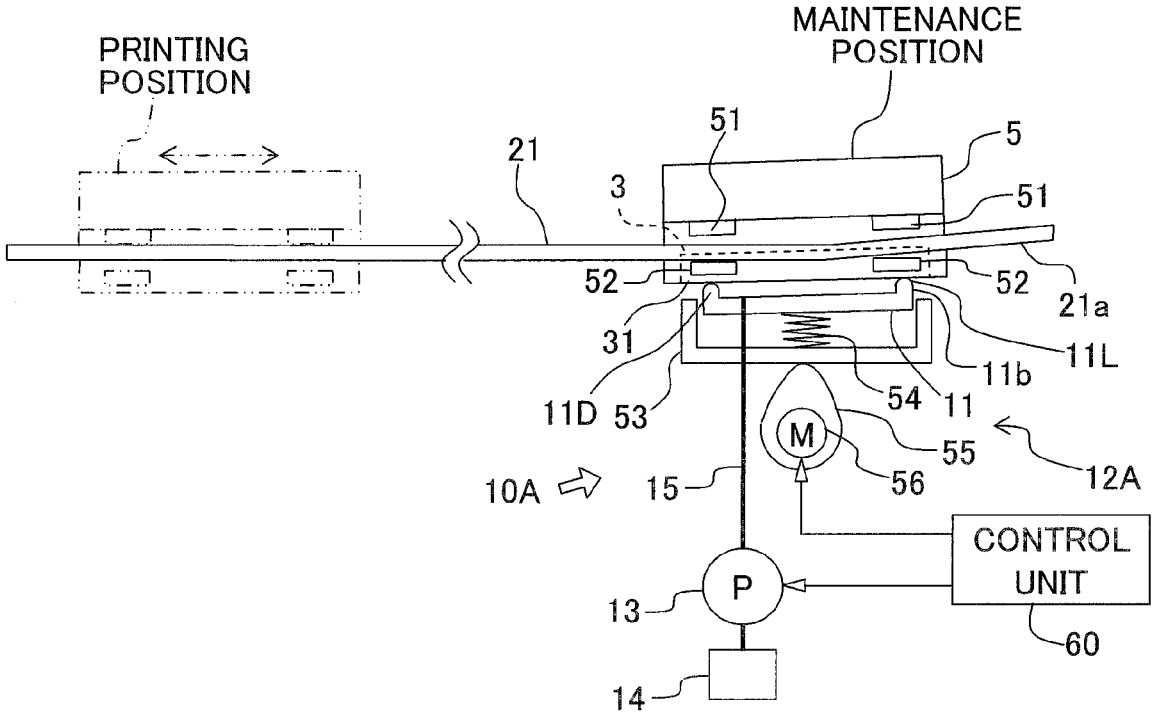
FIG. 11 schematically shows an arrangement of a purge unit of the ink-jet type printer according to the second embodiment.

As shown in FIGS. 1, 10, and 11, the carriage 5, which carries the discharge head unit 4, is reciprocatively movable in the main scanning direction by means of the scanning mechanism provided on the frame 2, along with two guide shafts 21, 22 provided on the frame 2 as well. The carriage 5 is provided with upper sliders 51 and lower sliders 52 respectively. The guide shaft 21 is arranged between the upper sliders 51 and the lower sliders 52. Owing to the arrangement as described above, the upper sliders 51 are slidably movable on the upper surface of the guide shaft 21, and the lower sliders 52 are slidably movable on the lower surface of the guide shaft 21. The upper sliders 51 and the lower sliders 52 do not abut against the guide shaft 21 simultaneously. In other words, when the upper sliders 51 abut against the guide shaft 21, the guide shaft 21 and the lower sliders 52 are separated from each other. On the contrary, when the guide shaft 21 abuts against the lower sliders 52, the guide shaft 21 and the upper sliders 51 are separated from each other.

The portion of the guide shaft 21 except for one end portion 21*a* in the main scanning direction extends substantially horizontally in the main scanning direction. The one end portion 21*a* in the main scanning direction is warped upwardly. When the carriage 5 is guided by the one end portion 21*a* of the guide shaft 21, the discharge head 3 is located at the maintenance position. The lower surface of the discharge head 3 has an inclined posture when the discharge head 3 is located at the maintenance position, because the one end portion 21*a* of the guide shaft 21 is warped upwardly. That is, when the discharge head 3 is disposed at the maintenance position, the nozzle surface 31, on which the plurality of nozzles 32 are open, has the inclined posture.

When the discharge head 3 is disposed at the maintenance position, the nozzle surface 31 is inclined in the direction (main scanning direction) substantially perpendicular to the direction in which the nozzle arrays extend. In this situation, the nozzle arrays are arranged on the nozzle surface 31 so that the nozzle array for the pale color ink is positioned on the upper side of the inclination, and the nozzle array for the darkest color ink is positioned on the lower side of the inclination.

As shown in FIG. 11, the printer 1 is provided with the purge unit 10A. The purge unit 10A includes the cap 11, a moving mechanism 12A which moves the cap 11 frontwardly and backwardly with respect to the nozzle surface 31, a suction pump 13 which is communicated with an ink suction space of the cap 11 via a connecting tube 15, a waste ink tank 14 which stores the inks sucked by the suction pump 13, and a control unit 60 which controls the moving mechanism 12A and the suction pump 13. The constitutive components of the purge unit 10A except for the moving mechanism 12A are the same as those explained in the first embodiment. In the following description, the moving mechanism 12A will be explained in detail, and the constitutive components of the purge unit 10A except for the moving mechanism 12A will be omitted from the explanation.

The moving mechanism 12A for the cap 11 is provided with a cam 55 which has a predetermined profile, an electric motor 56 which is provided as the driving mechanism for driving and rotating the cam 55, and a cap holder 53 which accommodates the cap 11. The cap holder 53 has a box-shaped form which is open at the upper portion thereof. The cap 11 is accommodated in the cap holder 53. A coil spring 54, which is used as the biasing mechanism, is provided on the inner bottom portion of the cap holder 53. The cap 11 is urged or biased upwardly by the coil spring 54.

In the arrangement described above, the circumferential surface of the cam 55, which is disposed at the lower position, abuts against the cap holder 53 which accommodates the cap 11. The cam 55 is rotated by the driving of the electric motor 56 which is subjected to the operation control by the control unit 60. The cap holder 53 (as well as the cap 11) is moved upwardly and downwardly depending on the phase (angle of rotation) of the cam 55. When the cap holder 53 is moved upwardly when the discharge head 3 is at the maintenance position (see FIG. 1), then the circumferential wall portion 11*b* of the cap 11 abuts against the nozzle surface 31 to give the capping state in which the plurality of nozzles 32 are covered with the cap 11 (FIG. 11).

When the cap 11 is in the capping state, the discharge head 3 is pushed upwardly by the cap 11 which is brought in contact from the lower position. The lower sliders 52 of the carriage 5 abut against the guide shaft 21. The nozzle surface 31 is inclined substantially with respect to the horizontal plane along with the inclination of one end portion 21*a* of the guide shaft 21. The cap 11, which abuts against the inclined nozzle surface 31, is also inclined.

Figure 12A:
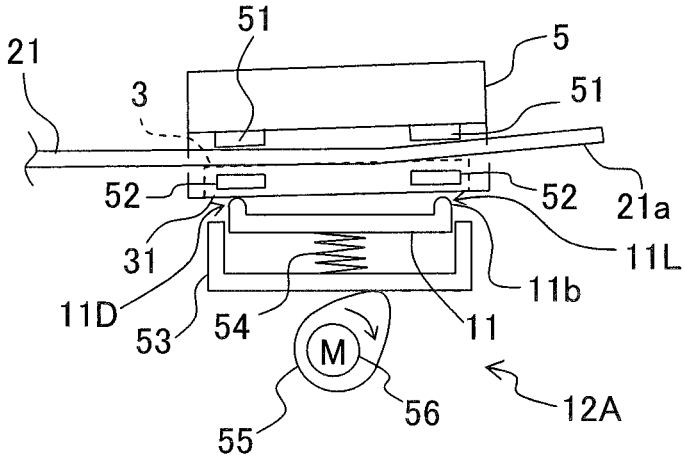

As shown in FIG. 12A, in the cap release operation after the purge operation, when the cam 55 is rotated by a predetermined angle to move the cap holder 53 downwardly by a predetermined amount, the following state is given. That is, the circumferential wall portion 11*b*, which is positioned at one end (11D) of the cap 11, abuts against the nozzle surface 31 by being urged by the coil spring 54, while the circumferential wall portion 11*b*, which is positioned at the other end (11L) of the cap 11, is separated downwardly from the nozzle surface 31. In this situation, the distance between the darkest color nozzle area and the inner bottom surface of the cap 11 is smaller than the distance between the pale color nozzle area and the inner bottom surface of the cap 11.

Figure 12B:
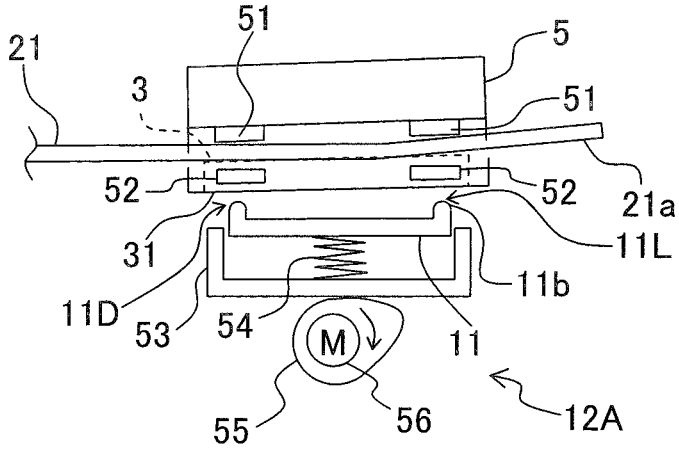

Subsequently, as shown in FIG. 12B, when the cam 55 is further rotated to move the cap holder 53 downwardly, the second separation state is given, in which the circumferential wall portion 11*b* of the cap 11 is completely separated from the nozzle surface 31 of the discharge head 3. When the cap 11 is completely separated from the nozzle surface 31 of the discharge head 3, the inner bottom surface of the cap 11 is substantially horizontal. The relationship is also maintained, in which the distance between the darkest color nozzle area and the inner bottom surface of the cap 11 is smaller than the distance between the pale color nozzle area and the inner bottom surface of the cap 11, during the period in which the state is changed from the first separation state to arrive at the second separation state.

As described above, the moving mechanism 12A of the purge unit 10A of the printer 1 is constructed so that the cap 11 is separated from the nozzle surface 31, while the distance between the darkest color nozzle area positioned at one end of the nozzle surface 31 and the cap 11 is smaller than the distance between the pale color nozzle area positioned at the other end of the nozzle surface 31 and the pale color nozzle area. Owing to the arrangement as described above, the distance between the inner bottom surface of the cap 11 and the darkest color nozzle area is smaller than the distance between the inner bottom surface of the cap 11 and the pale color nozzle area, in the cap release operation during the maintenance for the printer 1. Therefore, the ink bridge, which appears between the cap 11 and the nozzle surface 31 during the cap release operation after the purge operation, is formed in the darkest color nozzle area.

When the ink bridge is formed in darkest color nozzle area in the cap release operation, then the flow, which is directed toward the nozzle array for the dark color ink, is generated in the ink on the nozzle surface 31. Accordingly, the dark color ink can be prevented from flowing toward the nozzle array for the pale color ink on the nozzle surface 31. Accordingly, it is possible to avoid the color mixture of the inks which would be otherwise advanced into or allowed to invade into the nozzles, during the period ranging from the cap release operation to the wipe operation, especially in relation to the nozzles for the pale color ink. When the color mixture of the inks is suppressed in the nozzles for the pale color ink, then the number of times of the flashing is not uselessly increased in the flashing operation, and it is possible to suppress the amount of ink consumption.

Third Embodiment

Figure 13:
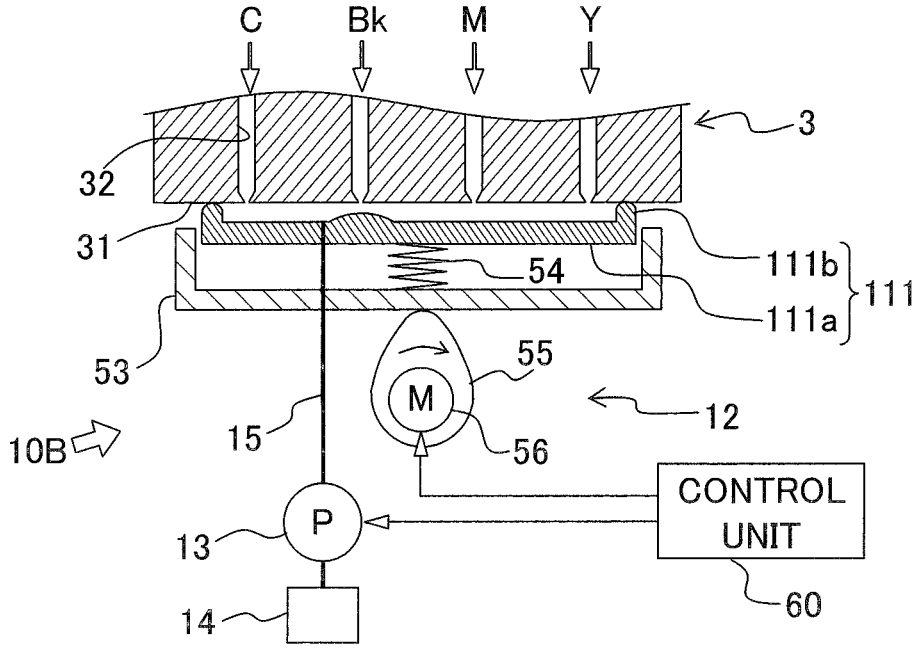
FIG. 13 schematically shows an arrangement of a purge unit of an ink-jet type printer according to a third embodiment.

In the case of the nozzle surface 31 of the discharge head 3 of the printer 1 according to the first embodiment described above, the plurality of nozzles 32 are arranged in the array form for each of the ink colors to form the plurality of nozzle arrays. The nozzle array for the darkest color ink, which is included in the plurality of nozzle arrays, is arranged at one end of the nozzle surface 31 perpendicular to the nozzle array direction. On the contrary, as shown in FIG. 13, in the case of a nozzle surface 31 of a discharge head 3 of the printer 1 according to this embodiment, the nozzle arrays, which discharge the inks of the respective colors, are aligned in an order of the cyan (C), the black (Bk), the magenta (M), and the yellow (Y). The nozzle array, which is provided for the black as the darkest color ink, is arranged at a position to be interposed between the nozzle arrays for the inks of the other colors. In other words, the nozzle array for the darkest color ink is not arranged at the end of all of the nozzle arrays.

An explanation will now be made about the purge unit 10B of the printer 1 according to this embodiment. The purge unit 10B of the printer 1 includes a cap 111, a moving mechanism 12 which moves the cap 111 in a substantially horizontal posture frontwardly and backwardly with respect to the nozzle surface 31 of the discharge head 3, a suction pump 13 which is communicated with an ink suction space of the cap 111 via a connecting tube 15, a waste ink tank 14, and a control unit 60. The constitutive components of the purge unit 10B except for the cap 111 are the same as those of the purge unit 10A explained in the second embodiment described above. In the following description, the cap 111 will be explained in detail, and the same or corresponding elements are designated by the same reference numerals, any duplicate explanation of which will be omitted.

The cap 111 has a box-shaped form which is open at the upper portion thereof and which is composed of a bottom wall portion 111*a* and a circumferential wall portion 111*b* which is provided on four sides of the bottom wall portion 111*a*, wherein an internal space, which is surrounded by the walls, functions as an ink suction space. The cap 111 is formed so that the cap 111 abuts against the nozzle surface 31 of the discharge head 3 at the circumferential wall portion 111*b* thereof and the cap 111 can surround the plurality of nozzles 32 which are disposed on the nozzle surface 31 and which discharge the inks of the mutually different colors. In this embodiment, one cap 111 is provided for the discharge head 3. However, it is also possible to provide a plurality of caps 111 for the discharge head 3 as described above.

The cap 111 has a portion of the inner bottom surface of the cap 111 which is opposed to the darkest color nozzle area, the portion being formed to protrude so that the portion is disposed closely to the nozzle surface 31 as compared with the other portions in the capping state (FIG. 13) in which the entire circumference of the circumferential wall portion 111*b* abuts against the nozzle surface 31. Specifically, the ridge protruding in a ridge line form corresponding to the nozzle array or a plurality of projections corresponding to the respective nozzles is/are formed at the portion of the inner bottom surface of the cap 111, the portion being opposed to the nozzle array for the black as the darkest color ink in the capping state. It is not necessarily indispensable that the plurality of projections should correspond to the nozzles one to one. It is also allowable to provide a plurality of projections each corresponding to a plurality of nozzles.

Figure 14:
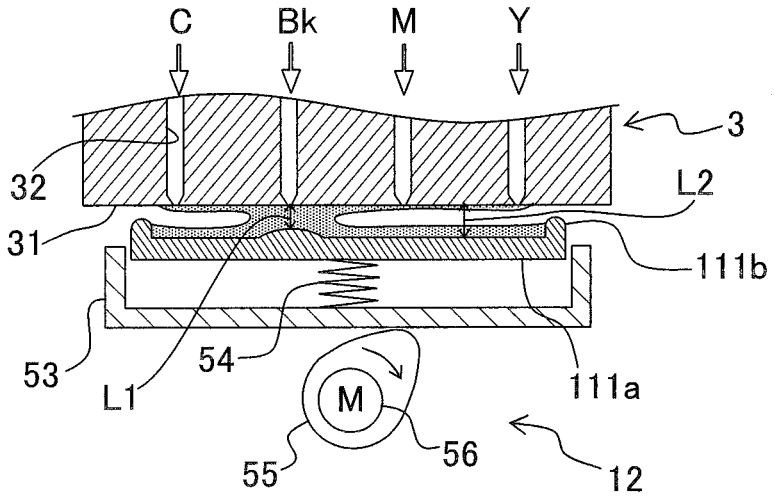
FIG. 14 shows an embodiment in which a cap is released downwardly from a capping state shown in FIG. 13.

When the cap 111, which is in the capping state, is moved downwardly by a predetermined amount in a substantially horizontal posture by means of the moving mechanism 12, the separation state is given as shown in FIG. 14, in which the circumferential wall portion 111*b* of the cap 111 is completely separated from the nozzle surface 31. The relationship is maintained during the period in which the cap 111 arrives at the separation state from the capping state, wherein the distance L1 from the dark color nozzle area to the inner bottom surface of the cap 111 is smaller than the distance L2 from the pale color nozzle area to the inner bottom surface of the cap 111 (L1<L2). Therefore, the inks, which remain while being scattered over the entire nozzle surface 31, are collected in a small area to form an ink bridge/ink bridges during the period in which the state is changed from the capping state to arrive at the separation state. The ink bridge arrives at the area in which the distance between the nozzle surface 31 and the cap 111 is relatively small, i.e., the dark color nozzle area. In this way, the ink bridge, which is formed between the nozzle surface 31 and the cap 111 during the cap release operation after the purge operation, is formed in the dark color nozzle area.

When the ink bridge is formed in the dark color nozzle area during the cap release operation, then the flow, which is directed toward the nozzle array for the dark color ink, is generated in the ink on the nozzle surface 31, and it is possible to prevent the dark color ink from flowing toward the nozzle array for the pale color ink on the nozzle surface 31. Accordingly, it is possible to suppress the color mixture of the inks which would be otherwise advanced into or allowed to invade into the nozzles, during the period ranging from the cap release operation to the wipe operation especially in relation to the nozzles for the pale color ink. When the color mixture of the inks is suppressed in the nozzles for the pale color ink, then the number of times of the flashing is not uselessly increased in the flashing operation, and it is possible to suppress the amount of ink consumption.

In this embodiment, the ridge or the projection is formed at the portion of the inner bottom surface of the cap 111 opposed to the nozzle array for the black as the darkest color ink. However, the present teaching is not limited thereto. The ridge or the projection may be formed at any portion opposed to the nozzle array for the ink of any other color. When the ridges or the projections are formed corresponding to the nozzle arrays for the inks of a plurality of colors, the height of the ridge or the projection corresponding to the nozzle array for the darkest color ink may be higher than the height of the ridge or the projection corresponding to the nozzle array of the ink of any other color. In this arrangement, the ridge or the projection, which corresponds to the nozzle array for the darker color ink, may be formed to be higher.

In the embodiments and the modified embodiments thereof described above, any difference in the degree of water repellency may be provided on the inner bottom surface of the cap. In this case, the ink bridge, which is formed between the nozzle surface of the discharge head and the cap during the cap release operation after the purge operation, can be controlled so that the ink bridge is reliably formed in the dark color nozzle area. In this case, the water-repelling treatment may be applied to the inner bottom surface of the cap so that the portion of the inner bottom surface of the cap, which is opposed to the nozzle array for the darkest color ink, has the water repellency which is lower than the water repellency of any other portion. In the embodiments and the modified embodiments thereof described above, the water-repelling treatment may be applied to the nozzle surface entirely. In this case, it is suppressed that the ink remains on the nozzle surface. Therefore, the ink can be moved toward the cap efficiently.

The embodiments and the modified embodiments thereof described above are illustrative of the exemplary case in which the cap is inclined in only one direction with respect to the nozzle surface. However, the present teaching is not limited thereto. For example, the cap may be inclined with respect to the nozzle surface so that the distance between the inner bottom surface of the cap and the dark color nozzle area is shorter than the distance between the inner bottom surface of the cap and the pale color nozzle area, and then the cap may be further inclined in any distinct direction. For example, the cap may be inclined in a direction substantially perpendicular to the extending direction of the nozzle array so that the distance between the inner bottom surface of the cap and an area of the nozzle surface disposed on one end side in the extending direction of the nozzle array is shorter than the distance between the inner bottom surface of the cap and an area of the nozzle surface disposed on the other end side in the extending direction of the nozzle array.

The present teaching is applicable to the ink discharge apparatus which is provided with the discharge head having the nozzles for the inks of the plurality of colors existing on the nozzle surface of the discharge head and which performs the cap release operation after the purge operation.

What is claimed is:

1. An ink discharge apparatus which discharges a first ink of a first color and a second ink of a second color darker than the first color, the ink discharge apparatus comprising:

a discharge head which has a nozzle surface formed with a first nozzle through which the first ink is discharged and a second nozzle through which the second ink is discharged;

a cap which covers the first and second nozzles and which has an inner bottom surface facing the nozzle surface under a condition that the cap covers the first and second nozzles and a wall portion formed on the inner bottom surface;

a sucking mechanism which performs suction for a space defined by the cap and the nozzle surface;

a moving mechanism which moves the cap relative to the discharge head such that the cap is positioned at a capping position at which the cap covers the first and second nozzles, and that the cap is positioned at a retracted position at which the cap is separated from the discharge head; and a purge control mechanism which controls the sucking mechanism and the moving mechanism, wherein the purge control mechanism controls the sucking mechanism and the moving mechanism so that a purge operation is performed to suck the first and second inks present in the first and second nozzles via the cap in a state that the cap is positioned at the capping position, and after completion of the purge operation, the purge control mechanism controls the moving mechanism so that the cap is separated from the nozzle surface while making a second distance between the inner bottom surface and an area of the nozzle surface disposed in the vicinity of the second nozzle is smaller than a first distance between the inner bottom surface and an area of the nozzle surface disposed in the vicinity of the first nozzle.

2. The ink discharge apparatus according to claim 1, wherein the first and second nozzles are formed as a plurality of nozzles, respectively, forming first and second nozzle arrays each extending in a first direction, the second nozzle array being arranged at one end portion of the nozzle surface in a second direction perpendicular to the first direction; and the purge control mechanism controls the moving mechanism such that the cap is separated from the nozzle surface in an inclined posture in which the cap is inclined with respect to the nozzle surface so that a distance between the one end portion of the nozzle surface and a portion of the inner bottom surface of the cap facing the one end portion of the nozzle surface is smaller than a distance between the other end portion of the nozzle surface in the second direction and a portion of the inner bottom surface of the cap facing the other end portion of the nozzle surface.

3. The ink discharge apparatus according to claim 1, wherein the first and second nozzles are formed as a plurality of nozzles, respectively, forming first and second nozzle arrays each extending in a first direction, the second nozzle array being arranged at one end portion of the nozzle surface in a second direction perpendicular to the first direction; and the cap is separated from the discharge head by the moving mechanism while the discharge head is in an inclined posture so that a distance between the one end portion of the nozzle surface and a portion of the inner bottom surface of the cap facing the one end portion of the nozzle surface is smaller than a distance between the other end portion of the nozzle surface in the second direction and a portion of the inner bottom surface of the cap facing the other end portion of the nozzle surface.

4. The ink discharge apparatus according to claim 1, wherein the first and second nozzles are formed as a plurality of nozzles, respectively, forming first and second nozzle arrays each extending in a first direction, and a protrusion is formed at a portion of the inner bottom surface of the cap facing the second nozzle array, the protrusion protruding to be close to the nozzle surface than another portion of the inner bottom surface.

5. The ink discharge apparatus according to claim 1, wherein the first and second nozzles are formed as a plurality of nozzles, respectively, forming first and second nozzle arrays each extending in a first direction; and protrusions are formed at portions of the inner bottom surface of the cap facing the first and second nozzle arrays, respectively, the protrusions protruding to be close to the nozzle surface than another portion of the inner bottom surface, and a protrusion among the protrusions formed at one of the portions facing the second nozzle array is higher than another protrusion formed at the other portion facing the first nozzle array.

6. The ink discharge apparatus according to claim 5, wherein the protrusion is formed as a ridge-shaped portion which extends to face the second nozzle array.

7. The ink discharge apparatus according to claim 5, wherein the protrusion is formed as a plurality of projections which are formed corresponding to the second nozzles.

8. The ink discharge apparatus according to claim 1, wherein an area of the inner bottom surface, which faces the first nozzle, has a liquid repellency which is higher than a liquid repellency of an area which faces the second nozzle.

9. The ink discharge apparatus according to claim 2, wherein a projection is formed at the one end portion of the cap in the second direction, and a shaft portion which extends in the first direction is formed at the other end portion of the cap in the second direction, the moving mechanism includes: a cap holder which supports the cap rotatably around the shaft portion and which is formed with a bearing which supports the shaft portion and a stopper which is engaged with the projection to regulate a rotation of the cap; and a biasing mechanism which is provided on the cap holder and which biases the cap in a direction separating the cap from the cap holder, and a position of engagement, at which the projection and the stopper are engaged with each other, is arranged to be shifted with respect to the bearing in the direction separating the cap from the cap holder.

10. The ink discharge apparatus according to claim 2, wherein a first projection is formed at the one end portion of the cap in the second direction, and a second projection is formed at the other end portion of the cap in the second direction, the moving mechanism includes: a cap holder which supports the cap and which is formed with first and second engaging portions which are engageable with the first and second projections respectively; and a biasing mechanism which is provided on the cap holder and which biases the cap in a direction separating the cap from the cap holder, and a position, at which the first projection and the first engaging portion are engaged with each other, is arranged to be shifted, in the direction separating the cap from the cap holder, with respect to a position at which the second projection and the second engaging portion are engaged with each other.

11. The ink discharge apparatus according to claim 2, wherein the cap is formed with a shaft portion which extends in the first direction, the moving mechanism includes: a cap holder which supports the cap rotatably around the shaft portion and which has a bearing supporting the shaft portion; and a biasing mechanism which is provided on the cap holder and which biases the cap in a direction separating the cap from the cap holder, and the biasing mechanism is arranged to be shifted with respect to the bearing toward one side in the second direction.

12. The ink discharge apparatus according to claim 1, wherein the purge control mechanism controls the sucking mechanism so that the cap is filled with the first and second inks in the purge operation.

13. The ink discharge apparatus according to claim 1, wherein an air inlet port, which is formed to penetrate the cap and through which an air outside the cap enters into the space after the completion of the purge operation, is not formed in the cap.

* * * * *